United States Patent [19]

Brown

[11] 4,344,112

[45] Aug. 10, 1982

[54] ENVIRONMENTAL LAMP

[76] Inventor: Robert L. Brown, 1923 W. Greenfield, Apt. 1, Milwaukee, Wis. 53204

[21] Appl. No.: 193,929

[22] Filed: Oct. 6, 1980

[51] Int. Cl.[3] ..... F21V 33/00

[52] U.S. Cl. ..... 362/96; 362/218; 362/223; 362/294; 362/373; 362/376; 362/806

[58] Field of Search ..... 362/96, 218, 223, 294, 362/373, 376, 806

[56] References Cited

U.S. PATENT DOCUMENTS 2,359,021 9/1944 Cambell et al. ..... 362/96

4,167,034 9/1979 Noguchi ..... 362/806

*Primary Examiner*—Stephen J. Lechert, Jr.

[57] ABSTRACT

An ornamental lamp adapted to cause circulation of air in a room between the floor and the ceiling of the room. The ornamental lamp includes a hollow light permeable structure defining a vertical air flow passage and has as open upper end and an open lower end. A light source is supported in the hollow structure, and means are provided for shielding a portion of the inner surface of the hollow structure from heat radiated from the light source. The shielding means comprises a sleeve having an open upper end and an open lower end. The sleeve is spaced inwardly from the inner surface of the hollow structure and defines an air flow passage between the sleeve and the hollow structure.

9 Claims, 2 Drawing Figures

ENVIRONMENTAL LAMP

FIELD OF THE INVENTION

The invention relates to a lamp for use in a room for illuminating the room and including means for causing air circulation in the room to thereby effect a more uniform temperature in the room and to increase the efficiency of the existing heating systems and to decrease heating costs.

BACKGROUND OF THE INVENTION

Attention is directed to the Goetz U.S. Pat. No. 3,244,868; the Peterson U.S. Pat. No. 4,152,973; the Turro U.S. Pat. No. 3,959,642; and the Hughes U.S. Pat. No. 3,827,342.

Attention is further directed to the Supplee U.S. Pat. No. 2,465,762; the Birch U.S. Pat. No. 1,824,388; and the Buffalow et al U.S. Pat. No. 1,755,204.

SUMMARY OF THE INVENTION

The present invention provides an ornamental lamp constructed in such a manner as to provide for circulation of air in a room and particularly to generate flow of air from the floor to the ceiling thereby generating an even temperature in the room, and maximizing the efficiency of the system heating the room.

More particularly, the ornamental lamp includes a hollow light permeable structure defining a vertical air flow passage and having an open upper end and an open lower end. A light source is supported in the hollow structure, and means are also provided for shielding a portion of the inner surface of the hollow structure from heat radiated from the light source. The shielding means comprises a sleeve surrounding the light source and having an open upper end and an open lower end. The sleeve is spaced inwardly from the inner surface of the hollow structure and defines an air flow passage between the sleeve and the hollow structure.

In one embodiment of the invention the hollow light permeable structure comprises an elongated hollow translucent plastic cylinder.

In one embodiment of the invention the light source is a light bulb.

In one embodiment of the invention the ornamental lamp further includes means for removably supporting the sleeve in the hollow tube.

Various other features and advantages of the invention are set forth in the following description, in the claims and in the drawings.

Figure 1:
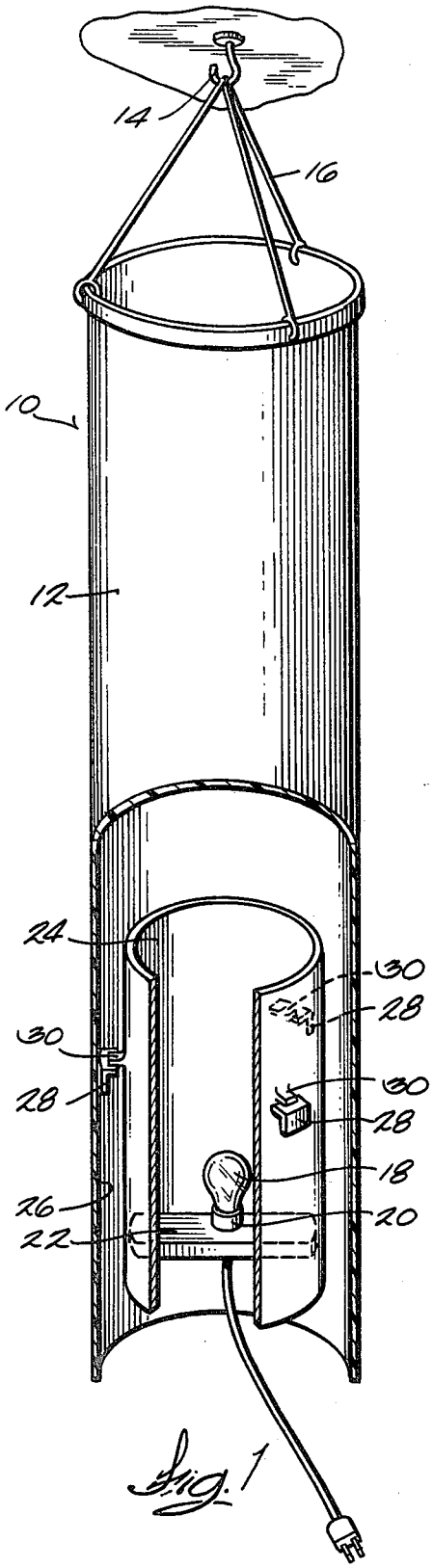
FIG. 1 is an elevation view of an ornamental lamp embodying the invention.

Before explaining the preferred embodiment in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is an ornamental lamp 10 embodying the invention. The lamp 10 is comprised of an elongated hollow tube 12 comprised of a translucent plastic material adapted to be suspended from a ceiling hook 14 by chains or other suspending means such as cords 16. In the illustrated construction the tube 12 may be approximately 10 inches in diameter and approximately 6 feet long. In other embodiments, the tube 12 can have varying lengths and be of various diameters and cross sectional shapes. Additionally, in other embodiments, other means can be employed for supporting the tube, e.g. a stand positioned below the tube 12, provided that the stand does not retard air flow through the lower end of the tube.

The lamp further includes a light emitting element shown in FIG. 1 as a conventional incandescent bulb 18, the light bulb 18 being located in a lower portion of the tube 12 and being suspended centrally therein. The light bulb 18 is supported by a light socket 20 of conventional design.

Means are also provided for preventing heat radiating from the light bulb 18 from unduly heating that portion of the plastic tube surrounding the light bulb. In the illustrated construction, the means for controlling heat radiation comprises a metal sleeve 24 surrounding the light bulb 18 and spaced inwardly from the internal surface 26 of the plastic tube 12. The radiant heat emitted by the light bulb 18 functions to heat the metal sleeve 24. The metal sleeve 24 like the tube 12, is open at both its upper and lower end to permit vertical air flow therethrough. The air flowing upwardly through the tube 12 is heated by the light bulb 18 and also by the metal sleeve 24.

The means for controlling heat radiation also includes means for supporting the light socket 20, the supporting means comprising a support bracket 22 having opposite ends fixed to the metal sleeve 24 and rigidly supporting the socket 20 of the light bulb 18.

Means are also provided for supporting the metal sleeve 24 for relatively easy removal such that the light bulb 18 can be easily replaced.

The supporting means is comprised of a plurality of brackets 28 fixed to the inner surface of the plastic tube 12 and spaced circumferentially around the tube. The sleeve 24 includes a plurality of complementary flanges 30 extending outwardly from its external surface and spaced circumferentially around the sleeve. The flanges 30 are adapted to rest on the inwardly extending brackets 28 of the plastic tube whereby the sleeve 24 is supported in the plastic tube. The sleeve 24 can be rotated slightly so as to move the flanges 30 circumferentially with respect to the brackets 28 and the sleeve 24 can be pulled downwardly out of the lower end of the tube 12.

In operation of the lamp 10, the heat generated by the light bulb 18 is effective to heat the metal sleeve and the air in the lower end of tube 12 thereby causing an upward air flow in the tube 12. The translucent character of the plastic material comprising the tube also provides a large light emitting lamp yielding the soft light effect of indirect lighting. In the preferred form of the invention, the plastic tube of the lamp 10 is of sufficient length that the lower end of the lamp is relatively close to the floor of the room and the upper end is close to the ceiling. Accordingly, cool air near the floor of the room will be pulled into the lamp and move upwardly toward the ceiling where it will be discharged. The lamp 10 thus causes the cool air in the room to be continually forced upwardly toward the ceiling where the air is warmer. The result is less of a heat variation in the air adjacent the floor and that adjacent the ceiling, increasing the efficiency of the existing heating system for the room and permitting lower thermostat temperatures without decreasing the comfort of the occupants of the room.

While the heat from the lamp does effect some heating of the air in the room, the greatest effect of the lamp in improving the comfort of the room is caused by the effect of the lamp in circulating the air, i.e. mixing the air adjacent the ceiling with the air adjacent the floor. It is important to note that one of the features of the lamp is that it must be of sufficient length that its lower end will draw cooler air and the upper end will be in a zone of warmer air.

While the lamp functions to cause air circulation, it can also provide an attractive source of relatively soft light and thereby enhance the decor of a room.

Figure 2:
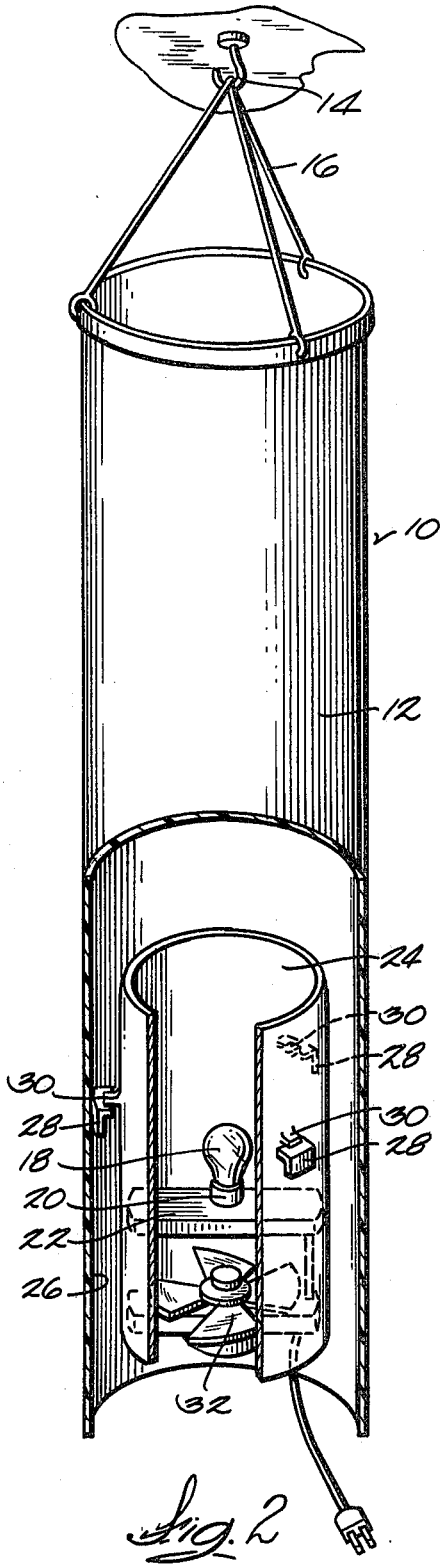
FIG. 2 is a partial elevation view of an alternative embodiment of the invention.

Illustrated in FIG. 2 is an alternative embodiment of the invention wherein the lamp 10 further includes a fan 32 housed in the sleeve 24 and adjacent the light bulb 18. The fan can be employed to cause improved air flow through the tube 12 thereby increasing the volume of air flow upwardly through the tube. In other arrangements the fan 32 can be employed to effect a downward air flow to cause heated air from the zone adjacent the ceiling of the room to flow downwardly to the floor area of the room.

While, in the illustrated embodiment the sleeve 24 is shown as being cylindrical, it should be understood that sleeve could have other shapes such as an inverted megaphone, provided that such alternative sleeves are not inconsistent with the operation described above.

Various features of the invention are set forth in the following claims.

I claim:

1. An ornamental lamp adapted to cause circulation of air in a room between the floor and the ceiling of the room, the ornamental lamp comprising means for providing a generally vertical air flow conduit from a zone of the room adjacent the floor to a zone of the room adjacent the ceiling, said air flow conduit means including a hollow elongated cylindrical light preamble structure having a length at least several times its diameter and having an open upper end adapted to be positioned adjacent the ceiling of a room, and an open lower end adapted to be positioned adjacent the floor of a room, and said hollow elongated cylindrical structure having an inner surface, a light source supported in said hollow structure, and means for shielding a portion of said inner surface surrounding said light source from said light source, said shielding means comprising a sleeve having an open upper end and an open lower end and providing a vertical air flow passage within said hollow structure, said sleeve being spaced inwardly from said inner surface of said hollow structure and defining an air flow passage between said sleeve and said hollow structure.

2. An ornamental lamp as set forth in claim 1 wherein said hollow light permeable structure comprises an elongated hollow plastic cylinder.

3. An ornamental lamp as set forth in claim 2 wherein said plastic cylinder is translucent.

4. An ornamental lamp as set forth in claim 1 wherein said hollow light permeable structure is an elongated hollow translucent tube.

5. An ornamental lamp as set forth in claim 1 wherein said light source is a light bulb.

6. An ornamental lamp as set forth in claim 1 wherein said sleeve includes means for supporting said light source, and further including means for removably supporting said sleeve in said hollow structure.

7. An ornamental lamp as set forth in claim 1 wherein said light source is located adjacent said lower end of said hollow structure and directs light upwardly in said hollow structure.

8. An ornamental lamp as set forth in claim 1 and further including means for forcing air through said hollow structure and in the direction of its longitudinal axis.

9. An ornamental lamp as set forth in claim 1 and further including means for supporting said hollow structure with said lower end spaced from the floor of the room whereby air flow through said lower end of said hollow structure and air flow through said upper end of said hollow structure is substantially unrestricted.

* * * * *